US006597370B1

(12) United States Patent
Lee

(10) Patent No.: US 6,597,370 B1
(45) Date of Patent: Jul. 22, 2003

(54) APPARATUS AND METHOD FOR COMPENSATING CLOCK PHASE OF MONITOR

(75) Inventor: Jae Min Lee, Taegu-shi (KR)

(73) Assignee: LG Electronics Inc., Seoul (KR)

( * ) Notice: Subject to any disclaimer, the term of this patent is extended or adjusted under 35 U.S.C. 154(b) by 376 days.

(21) Appl. No.: 09/635,874

(22) Filed: Aug. 10, 2000

(30) Foreign Application Priority Data

Aug. 12, 1999 (KR) ..... 1999-33172

(51) Int. Cl.[7] ..... G09G 5/00
(52) U.S. Cl. ..... 345/660
(58) Field of Search ..... 345/660

(56) References Cited

U.S. PATENT DOCUMENTS

| | | | | |
|---|---|---|---|---|
| 5,625,379 A | | 4/1997 | Reinert et al. | 345/154 |
| 5,790,096 A | * | 8/1998 | Hill, Jr. | 345/600 |
| 5,841,430 A | * | 11/1998 | Kurikko | 345/213 |
| 5,917,461 A | * | 6/1999 | Sakami et al. | 345/29 |
| 5,940,136 A | * | 8/1999 | Abe et al. | 348/537 |
| 5,990,968 A | * | 11/1999 | Naka et al. | 348/537 |
| 6,023,522 A | * | 2/2000 | Draganoff et al. | 382/124 |
| 6,097,379 A | * | 8/2000 | Ichiraku | 345/213 |

FOREIGN PATENT DOCUMENTS

| | | |
|---|---|---|
| EP | 0791913 A2 | 8/1997 |
| WO | WO 98/23094 | 5/1998 |

* cited by examiner

*Primary Examiner*—Matthew C. Bella
*Assistant Examiner*—Manucher Rahmjoo
(74) *Attorney, Agent, or Firm*—Fleshner & Kim, LLP

(57) ABSTRACT

An apparatus for compensating a clock phase of a monitor is disclosed, in which a first memory stores reference digital data, a PLL generates a predetermined sampling clock, synchronized with a horizontal synchronizing signal and a vertical synchronizing signal applied from a main body, and an A/D converter samples an analog image signal received from the main body according to the sampling clock. The A/D converter converts the analog image signal to a digital image signal, and a second memory temporarily stores the digital image signal by a frame unit, after a scaler formats it as a frame. A microcomputer extracts digital data from the digital signal output from the scaler to control the PLL according to whether the extracted digital data is substantially equal to the reference data stored in the first memory. Thus if a clock phase set by a user is changed, for example due to environment, the change can be detected and automatically compensated to maintain a normal screen state.

26 Claims, 2 Drawing Sheets

APPARATUS AND METHOD FOR COMPENSATING CLOCK PHASE OF MONITOR

BACKGROUND OF THE INVENTION

1. Field of the Invention

The present invention relates to a video monitor, and more particularly to an apparatus and a method for compensating a distorted clock phase.

2. Background of the Related Art

In general, a video monitor is an apparatus for displaying an image signal having an image mode such as SVGA (800×600), XGA (1024×768), SXGA (1280×1024), for example, which is transmitted from a main body connected to the monitor, after a series of signal processing. The main body is, for example, a video card of a work station or a personal computer.

Further, the monitor was originally based on a cathode-ray tube technology. Recently, a digital type monitor using an LCD as a typical plate type displaying element appropriate for a large sized monitor has been commercialized, as there is a tendency toward large sized display apparatus in response to the development of the modern technique.

A related art monitor, as shown in FIG. 1, includes a microcomputer 1 for determining an image mode according to a frequency of a horizontal synchronizing signal and a vertical synchronizing signal transmitted from a main body. The microcomputer outputs a control signal to perform a signal processing operation according to the image mode. Next, a Phase Locked Loop (PLL) 2 is provided for generating a clock pulse based on a control signal of the microcomputer 1.

Also included is an A/D converter 3 for sampling R/G/B image signals transmitted from the main body according to the clock pulse provided by the PLL 2. The A/D converter converts the analog image signals to digital signals. A scaler 4 is provided for adjusting a size of the digital R/G/B signals output from the A/D converter 3 to a frame unit, in response to the control signal of the microcomputer 1 by using the clock pulse provided by the PLL 2.

Finally, a frame buffer memory 5 stores an output from the scaler 4, and an LCD module 6 outputs the image signals stored in the frame buffer memory 5 according to the control signal of the microcomputer 1.

The operation of the related art monitor as described above will be explained hereinafter.

First, the microcomputer 1 outputs a control signal to the PLL 2. The PLL 2, in turn, supplies a sampling clock corresponding to a frequency of horizontal/vertical synchronizing signals transmitted from the; main body to the A/D converter 3 and the scaler 4. Specifically, the PLL 2 generates a clock pulse preset according to a control signal of the microcomputer to supply the clock pulse to the A/D converter 3 and the scaler 4.

The A/D converter 3 samples the R/G/B image signals transmitted from the main body according to the sampling clock provided by the PLL 2, and thus converts the analog image signals to digital signals to be output to the scaler 4.

The scaler 4 then adjusts the size of the output of the A/D converter 3 according to a control signal of the microcomputer 1, and stores the adjusted output of the A/D converter 3 to the frame buffer memory 5. Then, the digital image signals thusly stored in the frame buffer memory 5 are displayed via a display module, such as the LCD module 6.

The related art monitor as described above, however, has many disadvantages. For example, a user must manually reset the clock phase to compensate for distortion of the clock phase, which can occur due to a change of temperature. A distortion of the clock phase can occur in response to a change of ambient temperature, and can cause a distortion of a screen.

SUMMARY OF THE INVENTION

An object of the invention is to solve at least the above problems and/or disadvantages and to provide at least the advantages described hereinafter.

Another object of the present invention is provide an apparatus and a method for compensating a clock phase of a monitor that substantially obviates one or more of the problems due to limitations and disadvantages of the related art.

Another object of the present invention is to provide an apparatus and a method for compensating a clock phase of a monitor, in which an image data displayed on a screen is compared with a prescribed reference data and a detected distortion of a clock phase is automatically compensated.

Another object of this invention is to allow a normal screen to be displayed when distortion of a clock phase is generated.

Another object of the invention is to detect an abnormal state of the screen.

To achieve at least these or other advantages in whole or in parts, there is provided an apparatus for compensating a clock phase of a monitor, including a first memory for storing a reference digital data Vram, a PLL for generating a predetermined sampling clock synchronized with a horizontal synchronizing signal H-Sync and a vertical synchronizing signal V-Sync applied from a main body, an A/D converter for sampling an analogue image signal applied from the main body according to the sampling clock generated by the PLL to convert the analogue image signal to a digital image signal, a second memory for temporarily storing the digital image signal output from the A/D converter by a frame unit, a scaler for transferring the digital image signal, which is output from the A/D converter and stored in the second memory for constituting a frame, according to a signal input timing of a display module, and a microcomputer for extracting a digital data from the digital signal output from the scaler to control the PLL according to whether the extracted digital data is in coincidence with the reference data stored in the first memory.

Also, to achieve at least these advantages, in whole or in parts, there is provided a method for compensating a clock phase of a monitor having a PLL, including setting a reference digital data, displaying a clock phase adjusting bar corresponding to the preset reference digital data on an OSD, extracting a digital data A displayed on a current screen after a predetermined time period, adjusting an output phase of a clock pulse by controlling the PLL so that the reference digital data is in coincidence with the digital data A displayed on a current screen after determining whether the reference digital data is in coincidence with the digital image data A displayed on the current screen, and storing the adjusted clock phase value if the adjusted digital data A is in coincidence with the set reference digital data.

To further achieve the above-described objects of the present invention in a whole or in parts, there is provided a display apparatus that includes a first memory to store reference data, a clock generator to generate a sampling clock synchronized with at least one synchronizing signal, a converter to convert a first format image signal into a second format image signal according to the sampling clock, a second memory to store the second format image signal as a frame unit, a scaler to form and transfer the frame unit second format image signal to a display module, and a microcomputer to extract data from the second format signal outputted from the scaler, compare it to the reference data, and to control the clock generator according to a result of the comparison.

To further achieve the above-described objects of the present invention in a whole or in parts, there is provided a method for compensating a clock phase of a monitor that includes setting a reference data value, displaying a clock phase adjusting bar corresponding to the reference data on an on screen display (OSD), extracting image data displayed on a screen after a first prescribed time period, determining whether the reference data substantially equals the image data, adjusting an output phase of a clock pulse by controlling a clock pulse generator to modify the image data, so that it substantially equals the reference data, and storing the adjusted clock phase value if the adjusted image data substantially equals the reference data.

To further achieve the above-described objects of the present invention in a whole or in parts, there is provided a method of controlling a video image that includes storing a prescribed reference value in a first memory, receiving a video signal of a first format in a video signal processor, converting the video signal of a first format to a video signal of a second format using a control signal based on frequency information extracted from the video signal of the first format, scaling the video signal of the second format to generate a frame unit and a feedback signal based on the video signal of the second format, feeding the feedback signal back to the video signal processor, and comparing the feedback signal to the reference value and adjusting the control signal based on the comparison.

To further achieve the above-described objects of the present invention in a whole or in parts, there is provided a video signal control system that includes a video signal processor, which receives a video input signal of a first format, generates a control signal therefrom, and converts the video signal to a second format, a first memory, coupled to the video signal processor, which stores at least one prescribed reference value, and a scaler to coupled to receive the video signal of a second format, generate a frame unit, and provide a feedback signal to the video signal processor, wherein the video signal processor uses the feedback signal to control the-conversion of the video signal.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Figure 1:
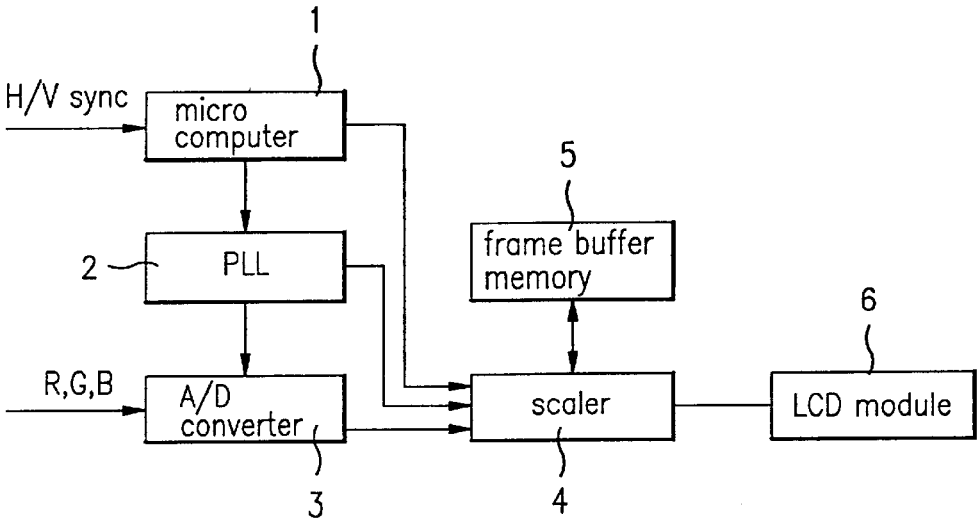
FIG.1 Prior Art
FIG. 1 is a schematical block diagram illustrating a related art monitor.
Figure 2:
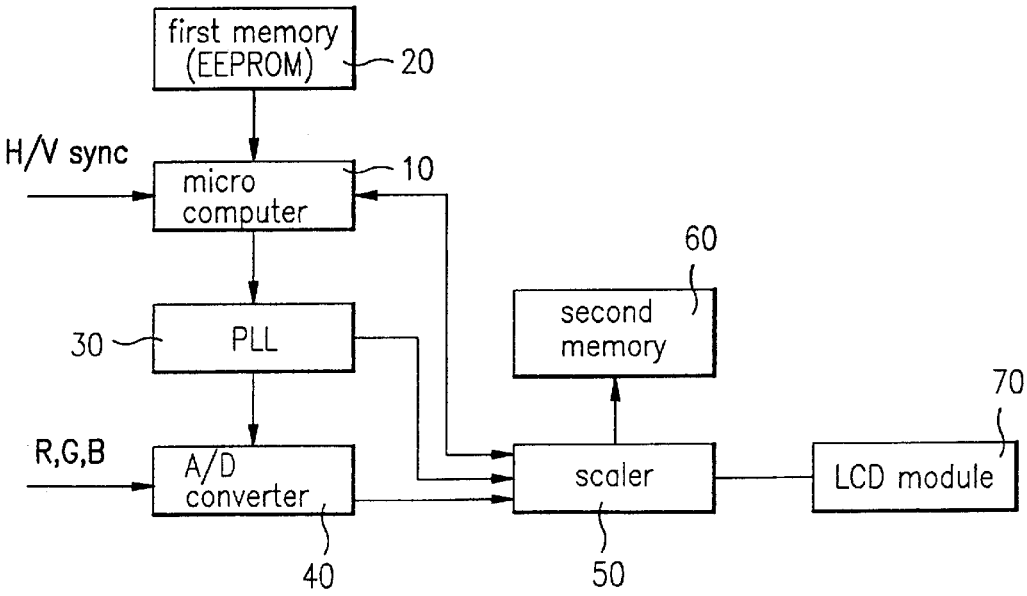
FIG. 2 is a schematical block diagram illustrating an apparatus for compensating a clock phase of a monitor according to a preferred embodiment of the present invention.

An apparatus for compensating a clock phase of a monitor according to a preferred embodiment of the present invention is shown in FIG. 2. It includes a phase locked loop (PLL) 30 for generating a clock pulse, and an A/D converter 40 for sampling analog R/G/B image signals transmitted from a main body. The sampling is accomplished according to the clock pulse provided by the PLL 30, and is done to convert the analog image signals to digital image signals.

Also provided is a first memory 20 for storing a prescribed reference value of an digital image data outputted from the A/D converter 40, and a microcomputer 10 for comparing the digital image data output, which is from the A/D converter 40 and fed back to the microcomputer 10, with the reference digital image data stored in the first memory 20. This is preferably done to control the PLL when an error is generated.

Next, a scaler 50 is provided for adjusting a size of the digital R/G/B image signals outputted from the A/D converter 40 to a frame unit by using the clock pulse provided by the PLL 30 according to a control signal of the microcomputer 10. A second memory 60 is provided for storing an output from the-scaler 50, and an LCD module 70 is used to display the digital image signals stored in the second memory after the size adjustment of the scaler 50. The first memory is preferably an EEPROM and the second memory 60 is preferably a frame buffer memory.

The operation of the apparatus for compensating a clock phase of a monitor constructed as above will now be described.

First, the microcomputer 10 generates and outputs a control signal to the PLL 30. The PLL uses this control signal to generate and supply the A/D converter 40 with a sampling clock according to a frequency of horizontal/vertical synchronizing signals transmitted from the main body. Specifically, the PLL 30 generates a clock pulse preset by a control signal of the microcomputer 10 to supply the clock pulse to the A/D converter 40.

The A/D converter 40 then samples the analog R/G/B image signals transmitted from the main body according to the clock pulse, and thus converts the R/G/B/image signals to digital image signals, and outputs the digital signals to the scaler 50.

The digital image signals output from the scaler 50 are then fed back to the microcomputer 10, and the microcomputer 10 extracts a predetermined area from the input digital image signals to detect a corresponding number of clock pulses. The detected number of clock pulse is compared with the reference data that is stored in the first memory 20, so as to detect generation of an abnormal clock phase.

That is, the microcomputer 10 determines whether the reference digital data stored in the first memory 20 corresponds (for example, is equivalent to) a currently detected digital data. It will then determine that an abnormal clock phase is generated if the currently detected digital data has a value larger or smaller than the reference digital data stored in the first memory. If this determination is made, the microcomputer 10 outputs a control signal to the PLL 30 to increase or decrease a variable of the PLL to change the PLL phase, thereby changing the digital image data output from the A/D converter 40.

Such a changed digital image data is compared with the reference digital image data again to compensate the clock phase.

The scaler 50 stores the output from the A/D converter 40, which is modified according to the control signal of the microcomputer 10, in the second memory 60 by a frame unit and then displays the output via the LCD module 70.

Figure 3:
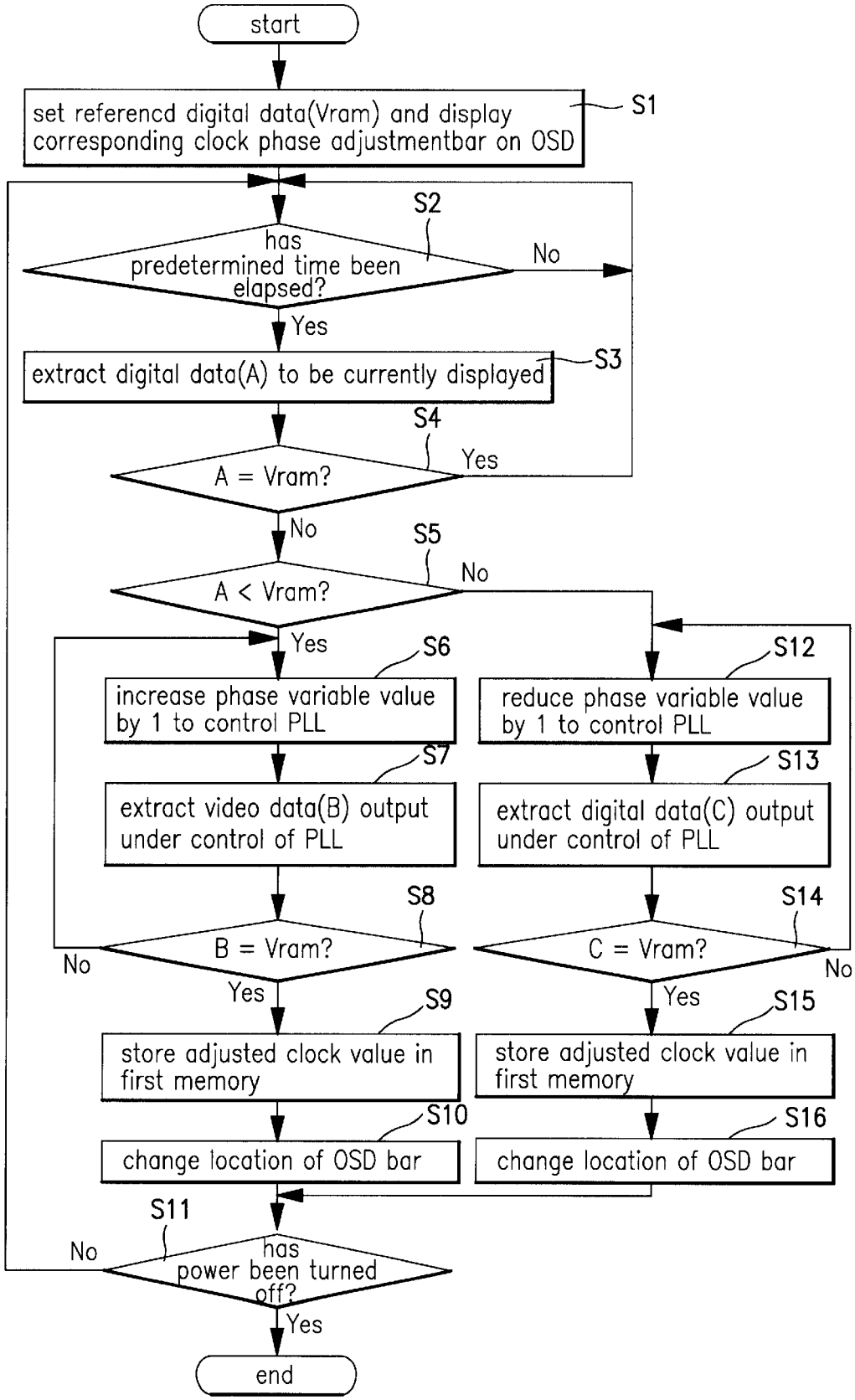
FIG. 3 is a flow chart showing a method for compensating a clock phase of a monitor according to a preferred embodiment of the present invention.

The operation of the apparatus for compensating a clock phase of a monitor according to the present invention will next be described. Referring to FIG. 3, a user preferably presets a reference digital image data Vram by a manual re-adjustment of data, and displays a position corresponding to the reference digital image data Vram on the OSD as shown in step S1.

Next, it is determined whether a predetermined time period has passed or not as shown in step S2. As a result of the determination of step S2, digital data (A) of a currently displayed screen is extracted if the predetermined time has passed as shown in step S3.

Next, it is determined whether the extracted digital data (A) corresponds to the reference digital data Vram stored in the first memory as shown in step S4.

If, as the result of the determination of step S4, the extracted digital data (A) does not correspond to the reference digital data Vram stored in the first memory, it is determined whether the extracted digital data (A) has a value smaller than the reference digital data as shown in step S5.

Based on the outcome of the step S5 determination, if the extracted digital data (A) has a smaller value than the reference digital value Vram stored in the first memory, it is determined that an abnormal clock phase is being generated. The PLL is thus controlled to sequentially increase the phase displayed on the OSD to control the clock phase as shown in step S6.

Next, as shown in step S7, digital image data B that is controlled by the PLL is extracted. Then, it is determined whether the controlled digital data B has a value equal to the reference digital data Vram as shown in step S8.

As a result of the determination in step S8, if the controlled digital data B has the same value as the reference digital data, a phase variable corresponding to such an update digital image data B is stored as shown in step S9. Additionally, a position of a bar on the OSD is changed correspondingly to the stored clock phase variable as shown in step S10.

Finally, as shown in step S11, it is determined whether a power supply was turned off or not to finish the whole routine.

On the other hand, as a result of the determination of step S5, the extracted digital data (A) has a value larger than the reference digital data Vram, the PLL is controlled to decrease the phase variable by 1 as shown in step S12.

A digital data C output by the control of the PLL is then extracted as shown in step S13, to determine whether the extracted digital data C corresponds to the stored reference digital value Vram as shown in step S14.

As a result of the determination as shown in step S14, if the extracted digital data C is equivalent to the stored reference digital data Vram, the controlled clock value is stored in the first memory as shown in step S15.

Also, as shown in step S16, the position of the bar on the OSD is changed corresponding to the controlled clock value.

In the apparatus and the method for compensating a clock phase of a monitor of preferred embodiments of the present invention, if a user inputs a signal and finishes a clock phase control in an optimum screen state, digital data is scanned from a predetermined area of the digital image data in the controlled state, and a number of sampled clock pulse of the digital data are set as a reference digital data Vram, to determine whether a clock phase is distorted or not.

That is, it is determined that the clock phase is distorted if a digital data displayed on a current screen has a different value than that of the preset reference digital data. In such a case, the clock phase is changed until the digital data displayed on the current screen equals the preset reference digital data. Additionally, the position of the clock phase controlling bar is revised according to the changed clock phase and displayed on the OSD at the revised position.

In the apparatus and the method for compensating a clock phase of a monitor of the preferred embodiment of the present invention, an abnormal state of a screen is detected by a prescribed time period, preferably preset by a user, and compensated automatically whenever the abnormal state is generated. Thus, a normal screen state may be maintained, thereby improving the reliability of the monitor.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A display apparatus, comprising:

a first memory to store reference data;

a clock generator to generate a sampling clock synchronized with at least one synchronizing signal;

a converter to convert a first format image signal into a second format image signal according to the sampling clock;

a second memory to store the second format image signal as a frame unit;

a scaler to form and transfer the frame unit second format image signal to a display module; and a microcomputer to extract data from the second format signal outputted from the scaler, compare it to the reference data, and to control the clock generator according to a result of the comparison.

2. The apparatus of claim 1, wherein the first memory is an EEPROM.

3. The apparatus of claim 1, wherein the reference data is a number of a clock pulse of the second format image signal, which is output from the scaler and sampled from a prescribed area after scanning.

4. The apparatus of claim 1, wherein the second memory is a frame buffer memory.

5. The apparatus of claim 1, wherein the first format is analog and the second format is digital, and the converter is an A/D converter.

6. The apparatus of claim 1, wherein the clock generator is a Phase Locked Loop.

7. A method for compensating a clock phase of a monitor, comprising:

setting a reference data value;

displaying a clock phase adjusting bar corresponding to the reference data on an on screen display (OSD);

extracting image data displayed on a screen after a first prescribed time period;

determining whether the reference data substantially equals the image data;

adjusting an output phase of a clock pulse by controlling a clock pulse generator to modify the image data, so that it substantially equals the reference data; and storing the adjusted clock phase value if the adjusted image data substantially equals the reference data.

8. The method of claim 7, wherein the step of adjusting an output phase of a clock pulse further comprises:

extracting image data by scanning a prescribed area of the image signal displayed on the current screen after the first prescribed time period;

determining whether the extracted image data is smaller than the reference data; and sequentially increasing a phase variable of the clock generator until the extracted image data equals the reference data, if the extracted image data was determined to be smaller than the reference data.

9. The method of claim 7, wherein the step of adjusting an output phase of a clock pulse further comprises:

extracting image data by scanning a prescribed area of the image signal displayed on the current screen after the first prescribed time period;

determining whether the extracted image data is larger than the reference data; and sequentially decreasing the phase variable of the clock generator until the extracted image data equals the reference data, if the extracted image data is first determined to be larger than the reference data.

10. The method of claim 7, wherein the image data is extracted again after a second prescribed time period if the extracted image data was initially equal to the reference data.

11. The method of claim 7, wherein the clock phase adjusting bar displayed on the OSD is updated according to the adjusted clock phase.

12. The method of claim 7, wherein the step of extracting image data to be displayed on the screen is carried out by periodically detecting the image data by a prescribed time unit.

13. The method of claim 7, wherein the output phase of the clock pulse is adjusted so that the image data equals the reference data.

14. The method of claim 7, wherein the image data is digital image data.

15. The method of claim 8, wherein the reference data is digital data.

16. A method of controlling a video image, comprising:

storing a prescribed reference value in a first memory;

receiving a video signal of a first format in a video signal processor;

converting the video signal of a first format to a video signal of a second format using a control signal based on frequency information extracted from the video signal of the first format;

scaling the video signal of the second format to generate a frame unit and a feedback signal based on the video signal of the second format;

feeding the feedback signal back to the video signal processor; and comparing the feedback signal to the reference value and adjusting the control signal based on the comparison.

17. The method of claim 16, wherein the first format is analog and the second format is digital.

18. The method of claim 16, wherein the control signal is adjusted if the feedback signal does not equal the reference value.

19. A video signal control system, comprising:

a video signal processor which converts a video input signal of a first format into a video signal of a second format;

a first memory which is coupled to the video signal processor and stores at least one prescribed reference value;

a scaler which adjusts a size of the video signal of the second format outputted from the video signal processor; and a controller which compares data extracted from the size-adjusted video signal to the prescribed reference value and corrects a clock phase error based on a result of the comparison.

20. The system of claim 19, wherein the first format is analog and the second format is digital.

21. The system of claim 19, further comprising:

a clock generator which generates a sampling clock, said video signal processor converting the video input signal of the first format to the video signal of the second format based on the sampling clock, wherein the controller controls the clock generator to correct the clock phase error based on the result of the comparison.

22. The system of claim 21, wherein the clock generator is a Phase Locked Loop (PLL).

23. The system of claim 19, wherein the first memory is an EEPROM.

24. The system of claim 19, wherein the extracted data is a number of clock pulses of the size-adjusted video signal, which is output from the scaler and sampled from a prescribed area after scanning.

25. The system of claim 19, further comprising a second memory which stores the frame unit video signal generated by the scaler.

26. The system of claim 25, wherein the second memory is a frame buffer memory.

* * * * *